US009827606B2

(12) United States Patent
Zhou et al.

(10) Patent No.: US 9,827,606 B2
(45) Date of Patent: Nov. 28, 2017

(54) STAMPING APPARATUS HAVING FLARED BEAD

(71) Applicants: Dajun Zhou, Troy, MI (US); Kaiping Li, Shelby Township, MI (US); Changqing Du, Troy, MI (US); Richard J Siemen, Shelby Township, MI (US)

(72) Inventors: Dajun Zhou, Troy, MI (US); Kaiping Li, Shelby Township, MI (US); Changqing Du, Troy, MI (US); Richard J Siemen, Shelby Township, MI (US)

(73) Assignee: FCA US LLC, Auburn Hills, MI (US)

( * ) Notice: Subject to any disclaimer, the term of this patent is extended or adjusted under 35 U.S.C. 154(b) by 0 days.

(21) Appl. No.: 14/959,391

(22) Filed: Dec. 4, 2015

(65) Prior Publication Data

US 2017/0157661 A1 Jun. 8, 2017

(51) Int. Cl.

| | |
|---|---|
| ***B21D 22/02*** | (2006.01) |
| ***B21D 22/04*** | (2006.01) |
| *B21D 24/04* | (2006.01) |
| *B21D 22/22* | (2006.01) |

(52) U.S. Cl.

CPC ..... *B21D 22/02* (2013.01); *B21D 22/04* (2013.01); *B21D 22/22* (2013.01); *B21D 24/04* (2013.01)

(58) Field of Classification Search

CPC ..... B21D 22/02; B21D 22/04; B21D 22/06; B21D 22/10; B21D 22/20; B21D 22/21; B21D 22/22; B21D 24/04; B21D 24/10

See application file for complete search history.

(56) References Cited

U.S. PATENT DOCUMENTS

| | | | | |
|---|---|---|---|---|
| 4,195,510 | A | 4/1980 | Juergens | |
| 4,432,222 | A * | 2/1984 | Ujihara | B21D 22/22 72/347 |
| 6,196,043 | B1 * | 3/2001 | Ehardt | B21D 22/22 72/350 |
| 6,860,135 | B2 * | 3/2005 | Yoshioka | B21D 22/02 72/348 |
| 7,322,222 | B2 * | 1/2008 | Kodaka | B21D 24/04 72/309 |
| 9,120,137 | B2 * | 9/2015 | Zhou | B21D 22/22 |
| 9,149,854 | B2 * | 10/2015 | Zhou | B21D 22/22 |

FOREIGN PATENT DOCUMENTS

DE 102010021330 A1 1/2011

* cited by examiner

*Primary Examiner* — R. K. Arundale
*Assistant Examiner* — Pradeep C Battula
(74) *Attorney, Agent, or Firm* — Ralph E. Smith

(57) ABSTRACT

A stamping apparatus for stamping a blank, including a lower die defining a cavity, the lower die including a land portion surrounding the cavity; a movable upper die including a drawing punch that corresponds to the cavity; and a binder movable towards the land portion of the lower die for engaging an edge portion of the blank, wherein the land portion of the lower die includes a plurality of depressions and the movable binder includes a plurality of beads that correspond to the depressions that mate to crimp the edge portion of the blank when the movable binder engages the edge portion of the blank, each of the plurality of depressions between separated by a flat region of the land portion, and each of the plurality of depressions including a central portion that extends along the cavity and a pair of end portions that extend away from the cavity.

16 Claims, 7 Drawing Sheets

STAMPING APPARATUS HAVING FLARED BEAD

FIELD

The present disclosure relates to a stamping apparatus having a flare bead.

BACKGROUND

A stamping apparatus is used to form or "stamp" a metal blank into a finished part that is used for, for example, a panel of a vehicle. To ensure that the metal blank is securely located between upper and lower dies of the stamping apparatus, a binder is engaged to the blank to secure the blank to the lower die before the upper die is actuated to stamp the blank and form the finished part. To ensure that an edge of the blank does not move during the stamping process or at least most moves in a controlled manner, even when engaged by the binder, the binder may include a bead formed thereon that corresponds to a depression or recess formed in the lower die. Tensile strains experienced by the blank at these locations, however, may cause the blank to break during the stamping process, which may render the finished part unusable.

In addition to single bead configurations, multiple bead configurations are known to more securely clamp the blank before stamping. These multiple bead configurations, however, increase the amount of scrap generated during the stamping process, which increases manufacturing costs. In addition, multiple bead configurations do not ensure that the blank does not warp or break when experiencing tensile strains.

For example, referring to FIG. 1, a blank 2 is illustrated that is stamped using a conventional stamping apparatus (not shown) having a plurality of elongated draw beads. As illustrated, the elongated draw beads form elongated depressions 4 in the blank 2 during the stamping process when the blank 2 is constrained by a binder (not shown) of the stamping apparatus. As also illustrated, warps or buckles 6 can develop at locations between the depressions 4, which are undesirable in the finished part. The buckles 6 develop between the depressions 4 due to the lack of blank material present between the depressions 4 that can elastically stretch during the stamping process.

SUMMARY

In a first aspect of the present disclosure, a stamping apparatus for stamping a blank is provided that includes a lower die defining a cavity, wherein the lower die includes a land portion surrounding the cavity, and a movable upper die including a drawing punch that corresponds to the cavity. A binder is movable towards the land portion of the lower die for engaging an edge portion of the blank, wherein the land portion of the lower die includes a plurality of depressions and the movable binder includes a plurality of beads that correspond to the depressions that mate to crimp the edge portion of the blank when the movable binder engages the edge portion of the blank. Each of the plurality of depressions being separated by a flat region of the land portion, and each of the plurality of depressions including a central portion that extends along the cavity and a pair of end portions that extend away from the cavity.

According to the first aspect, the end portions may extend away from the central portion at an angle $\alpha 1$ and an angle $\alpha 2$, respectively.

According to the first aspect, $\alpha 1$ may be equal to $\alpha 2$, or $\alpha 1$ may not be equal to $\alpha 2$.

According to the first aspect, $\alpha 1$ and $\alpha 2$ may each be in the range of 30 degrees to 80 degrees.

According to the first aspect, the central portion may include a length L1, each of the end portions may include a length L2, and a sum of the lengths L2 of the end portions may be about equal to the length L1.

According to the first aspect, a depth of the depression in each of the end portions may gradually decrease in a direction from the central portion toward a terminal end of the end portion.

According to the first aspect, the central portion may be curved in a direction away from the cavity.

According to a second aspect of the present disclosure, a stamping apparatus for stamping a blank is provided that includes a lower die defining a cavity, the lower die including a land portion surrounding the cavity; a movable upper die including a drawing punch that corresponds to the cavity; and a binder movable towards the land portion of the lower die for engaging an edge portion of the blank, wherein the land portion of the lower die includes a plurality of depressions and the movable binder includes a plurality of beads that correspond to the depressions that mate to crimp the edge portion of the blank when the movable binder engages the edge portion of the blank, the plurality of depressions extending about a perimeter of the cavity, each of the plurality of depressions being separated by a flat region of the land portion, and each of the plurality of depressions including a U-shaped flared configuration.

According to the second aspect, each of the plurality of depressions may include a central portion that extends along a portion of the perimeter of the cavity and a pair of end portions that extend away from the cavity.

According to the second aspect, the end portions may extend away from the central portion at an angle $\alpha 1$ and an angle $\alpha 2$, respectively.

According to the second aspect, $\alpha 1$ may be equal to $\alpha 2$, or $\alpha 1$ may not be equal to $\alpha 2$.

According to the second aspect, $\alpha 1$ and $\alpha 2$ may each be in the range of 30 degrees to 80 degrees.

According to the second aspect, the central portion may include a length L1, each of the end portions may include a length L2, and a sum of the lengths L2 of the end portions may be about equal to the length L1.

According to the second aspect, a depth of the depression in each of the end portions may gradually decrease in a direction from the central portion toward a terminal end of the end portion.

According to the second aspect, the central portion may be curved in a direction away from the cavity.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings referenced therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DETAILED DESCRIPTION

Example embodiments will now be described more fully with reference to the accompanying drawings.

Firstly, it should be understood that spatially relative terms, such as "inner," "outer," "beneath," "below," "lower," "above," "upper," and the like that may be used below are for ease of description to describe one element or feature's relationship to another elements or features as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 180 degrees or at other orientations) and the spatially relative descriptors used herein interpreted accordingly.

Figure 2:
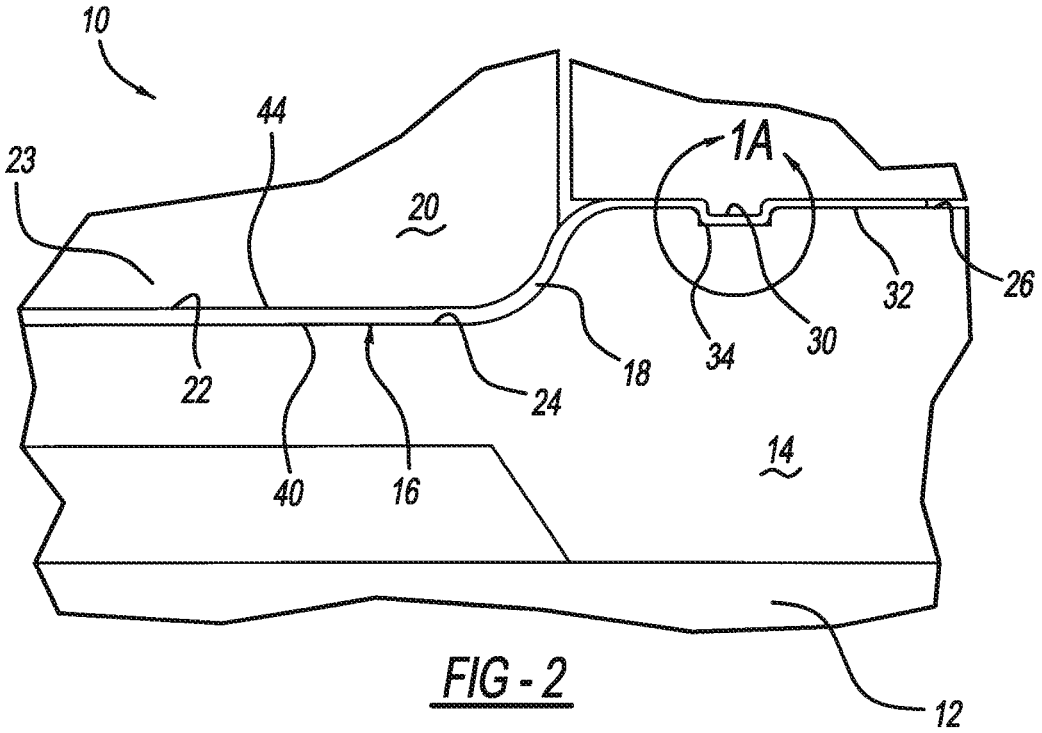
FIG. 2 is a partial cross-sectional view of an exemplary stamping apparatus according to a principle of the present disclosure.

FIG. 2 illustrates a cross-sectional view of an exemplary stamping apparatus 10 according to a principle of the present disclosure. Stamping apparatus 10 includes a stationary base member 12 constituted by a bolster plate having a stationary lower or constraining die 14 fixedly supported thereon. Constraining die 14 is formed with an upwardly open cavity 16 that is shaped according to the desired shape of an article to be drawn from a sheet metal blank 18.

Above the constraining die 14 is positioned an upper die 20 that is actuatable downwardly and upwardly by a main hydraulic or mechanical power device (not shown). Upper die 20 has lower surface portion 22 defining a drawing punch 23 correspondingly shaped to a surface 24 that defines cavity 16 formed in constraining die 14. Upper die 20 is thus movable toward and away from cavity 16 in constraining die 14 as upper die 20 is driven to move downwardly and upwardly, sequentially, by the main power device. Constraining die 14 has a raised land portion 26 surrounding or juxtaposing cavity 16.

Figure 2A:
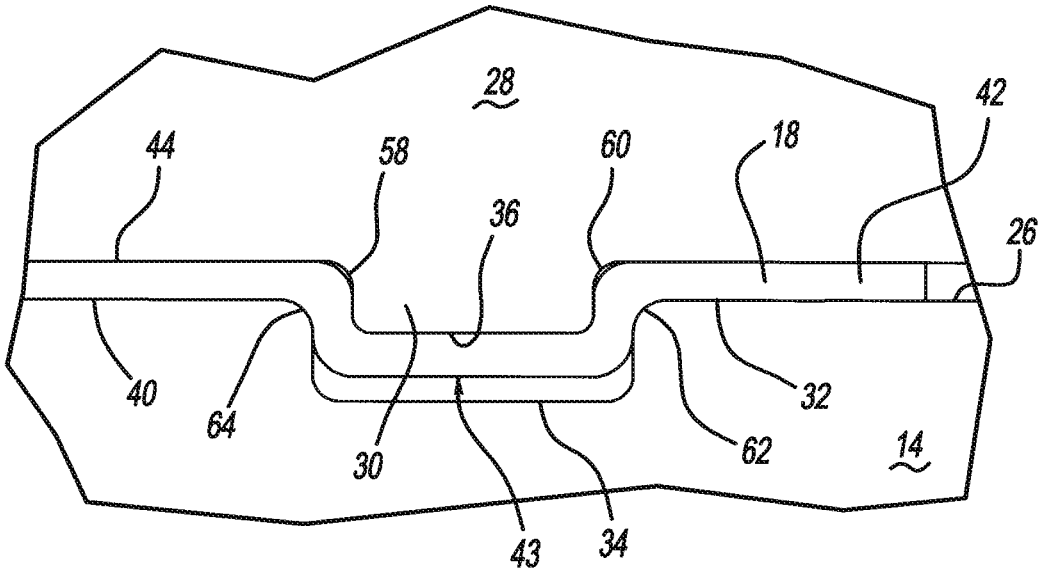
FIG. 2A is a partial cross-sectional view of a binder and land portion of a constraining die of the stamping apparatus illustrated in FIG. 1.

Above land portion 26 of constraining die 14 is positioned a blank-holding binder 28 that is actuatable downwardly and upwardly by an auxiliary power device (not shown). As best shown in FIG. 2A, blank-holding binder 28 defines a male draw bead 30, which is thus movable toward and away from land portion 26 of constraining die 14 as blank-holding binder 28 is driven to move downwardly and upwardly, sequentially, by the auxiliary power device.

Land portion 26 of constraining die 14 has a flat upper surface 32 constituting a first blank-holding surface extending around or along cavity 16 in constraining die 14, and is formed with an upwardly open depression (female draw bead) 34. A second blank-holding surface 36 defined by male draw bead 30 mates with depression 34 to crimp blank 18 therebetween. Although only a portion of stamping apparatus 10 is illustrated in FIGS. 2 and 2A, it should be understood that a plurality of male draw beads 30 and corresponding depressions 34 (FIG. 3) are configured to travel around an entire perimeter of constraining die 14.

In operation, sheet metal blank 18 is placed on constraining die 14 with a major portion 40 thereof located atop of cavity 16 in constraining die 14 and with an edge portion 42 located atop land portion 26, with the drawing and blank-holding binder 28 and upper die 20 being held in positions above the constraining die 14 (i.e., in a non-stamping position). The main and auxiliary power devices (not shown) are then actuated to drive the blank-holding binder 28 and upper die 20 to move downwardly. This causes the drawing punch 23 and the male draw bead 30 to move downwardly toward cavity 16 and land portion 26, respectively, of constraining die 14 and into pressing contact with an upper face 44 of sheet metal blank 18.

Before the drawing punch 23 comes into contact with sheet metal blank 18, male draw bead 30 is brought into pressing contact with sheet metal blank 18 and thereby has blank 18 or, more specifically, edge portion 42 of blank 18 clamped between first blank-holding surface 32 of land portion 26 and second blank-holding surfaces 36 of male draw beads 30. As a result, male draw beads 30 force edge portion 42 of blank 18 to partially crowd into depressions 34 in land portion 26. Edge portion 42 of sheet metal blank 18 is then forcefully gripped between blank-holding surfaces 32 and 36 not only by the pressure exerted between surfaces 32 and 36, but effectively by engagement between male draw bead 30 and depressions 34.

After sheet metal blank 18 is thus clamped firmly between blank-holding surfaces 32 and 36, drawing punch 23 is brought into pressing engagement with blank 18 and forces blank 18 to stretch into cavity 16 formed in constraining die 14 until blank 18 is forced against surface 24 defining cavity 16. Upon completion of the drawing operation performed as described above, edge portion 42 of blank 18 now having a series of crimps 43 formed in edge portion 42 is trimmed off from blank 18 during a trimming process. An article (not shown) such as, for example, a side panel or hood of a vehicle that is shaped conformingly to cavity 16 in constraining die 14 is thus obtained.

A drawback of the trimming process during which the crimps 43 and edge portion 42 is trimmed from the blank 18 is that particles, debris, and slivers can be formed. If any of the particles, debris, or slivers collect in cavity 16, imperfections in subsequently-formed articles can develop, which is undesirable. More specifically, after the drawing operation, the blank 18 may be trimmed using a trimming die in subsequent stamping operations. During this trimming process, the blank 18 is typically cut using the trimming shears from a terminal edge of the blank 18 inward toward the contoured portion 45 of the blank 18 formed by cavity 16 and drawing punch 23, and then peripherally around the contoured portion to entirely remove the edge portion 42. In some conventional stamping apparatuses, the draw bead is continuously formed in an uninterrupted manner around a periphery of the contoured portion 45. As such, when using the trimming dies are used to cut from a terminal edge of the blank 18 inward toward the contoured portion of the blank 18, the trimming diese must also cut through the crimps formed by the continuous draw bead. Due to the surface being uneven, the formation of dust, debris, and slivers are typically generated when cutting through the crimps, which is undesirable.

Figure 1:
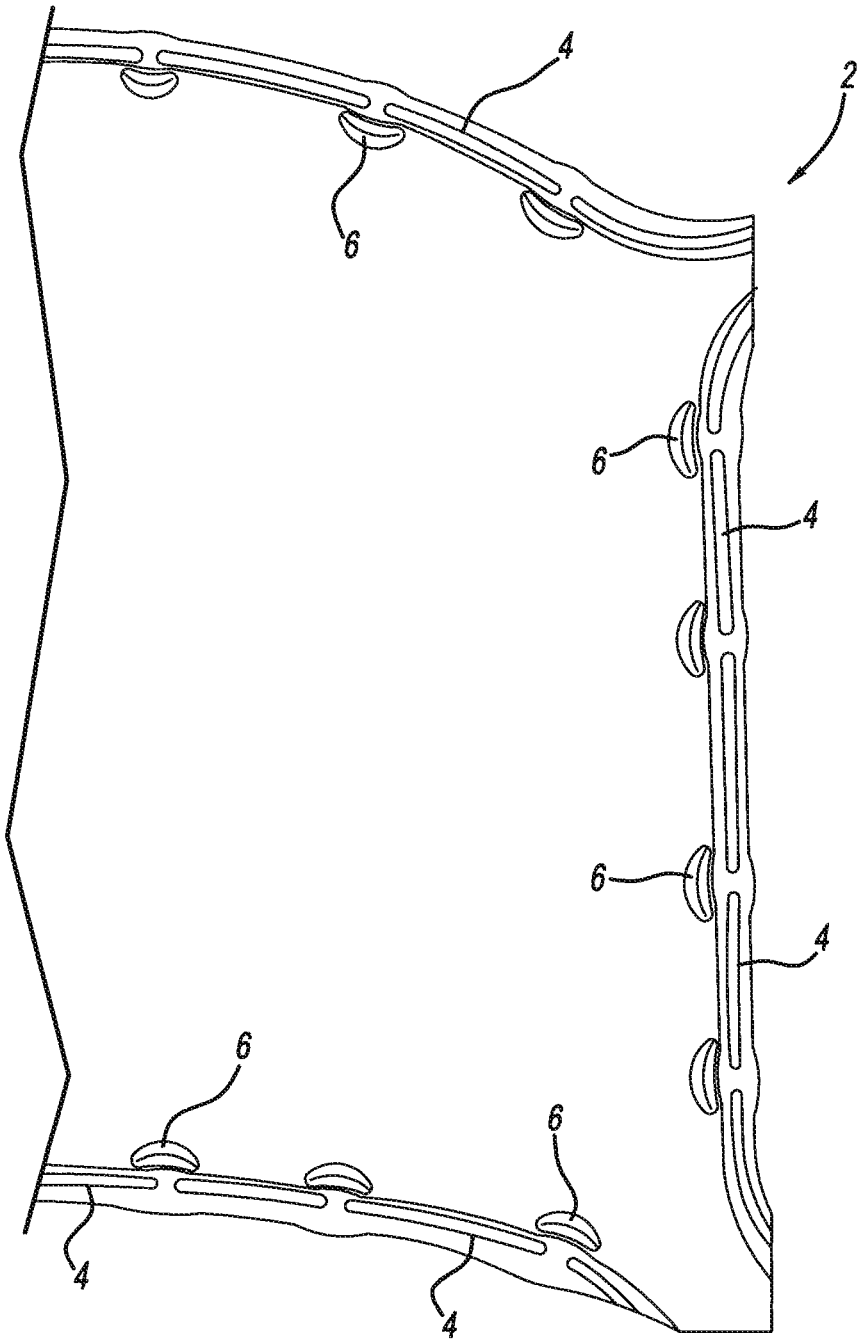
FIG - 1 Prior Art
FIG. 1 is a perspective view of a blank stamped using a conventional stamping apparatus having a plurality of elongated draw beads.
Figure 3:
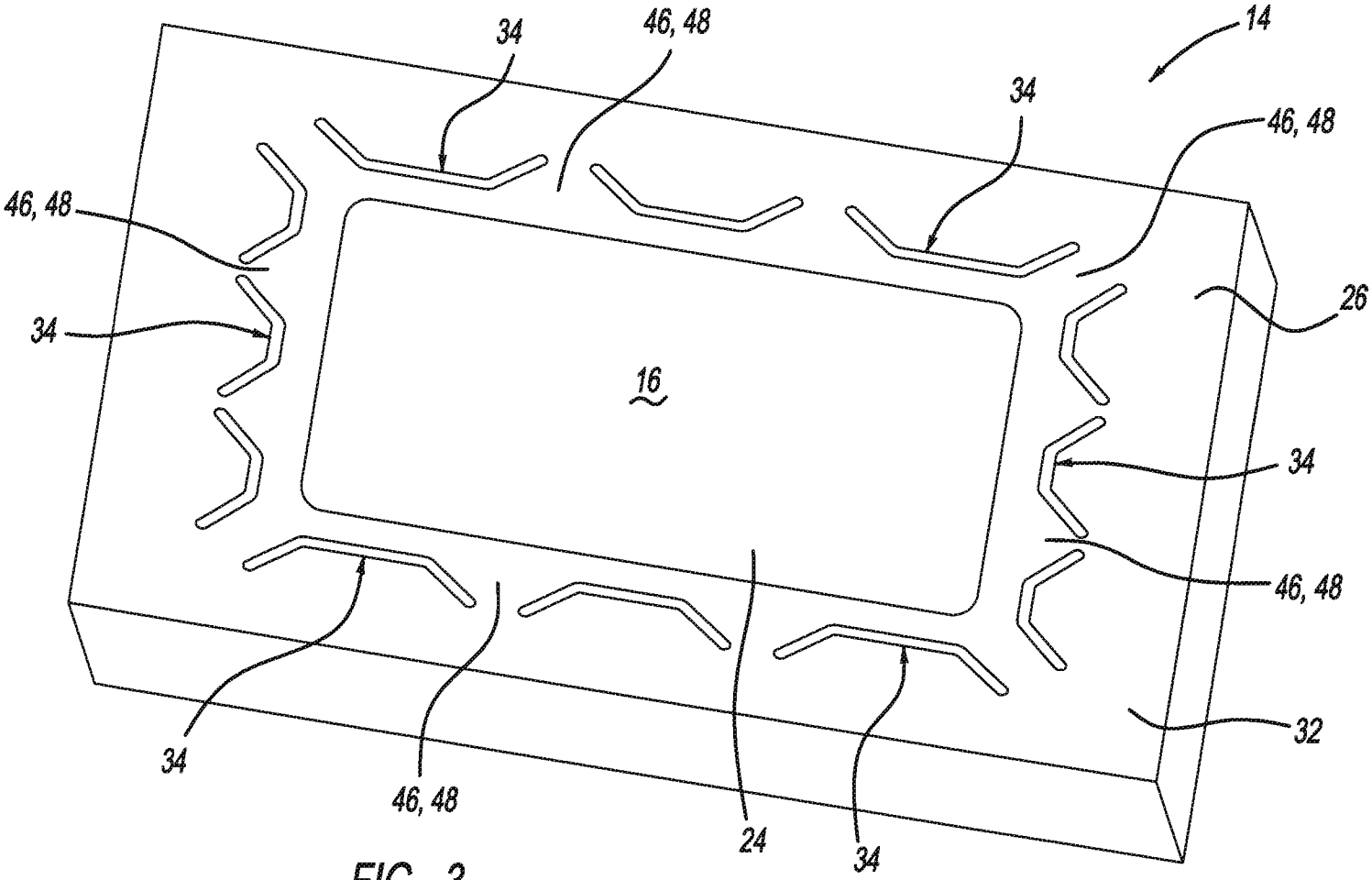
FIG. 3 is a perspective view of an exemplary constraining die according to a principle of the present disclosure.

To assist in preventing the formation of dust, debris and slivers during the trimming process, and to prevent the formation of the buckles 6 illustrated in FIG. 1, the present application provides stamping apparatus 10 having the plurality of male draw beads 30 and the plurality of corresponding depressions 34. As best shown in FIG. 3, which is a plan view of an exemplary constraining die 14, it can be seen that land portion 26 of constraining die 14 includes a plurality of U-shaped depressions 34 that mate with correspondingly shaped male draw beads 30 (not shown). In particular, it can be seen that each depression 34 is separated by a gap 46 such that a flat area 48 of land portion 26 is located between each depression 34. In this manner, during the subsequent trimming processes, a corresponding flat area 50 will also be formed between the crimps 43 imprinted into blank 18.

Figure 4:
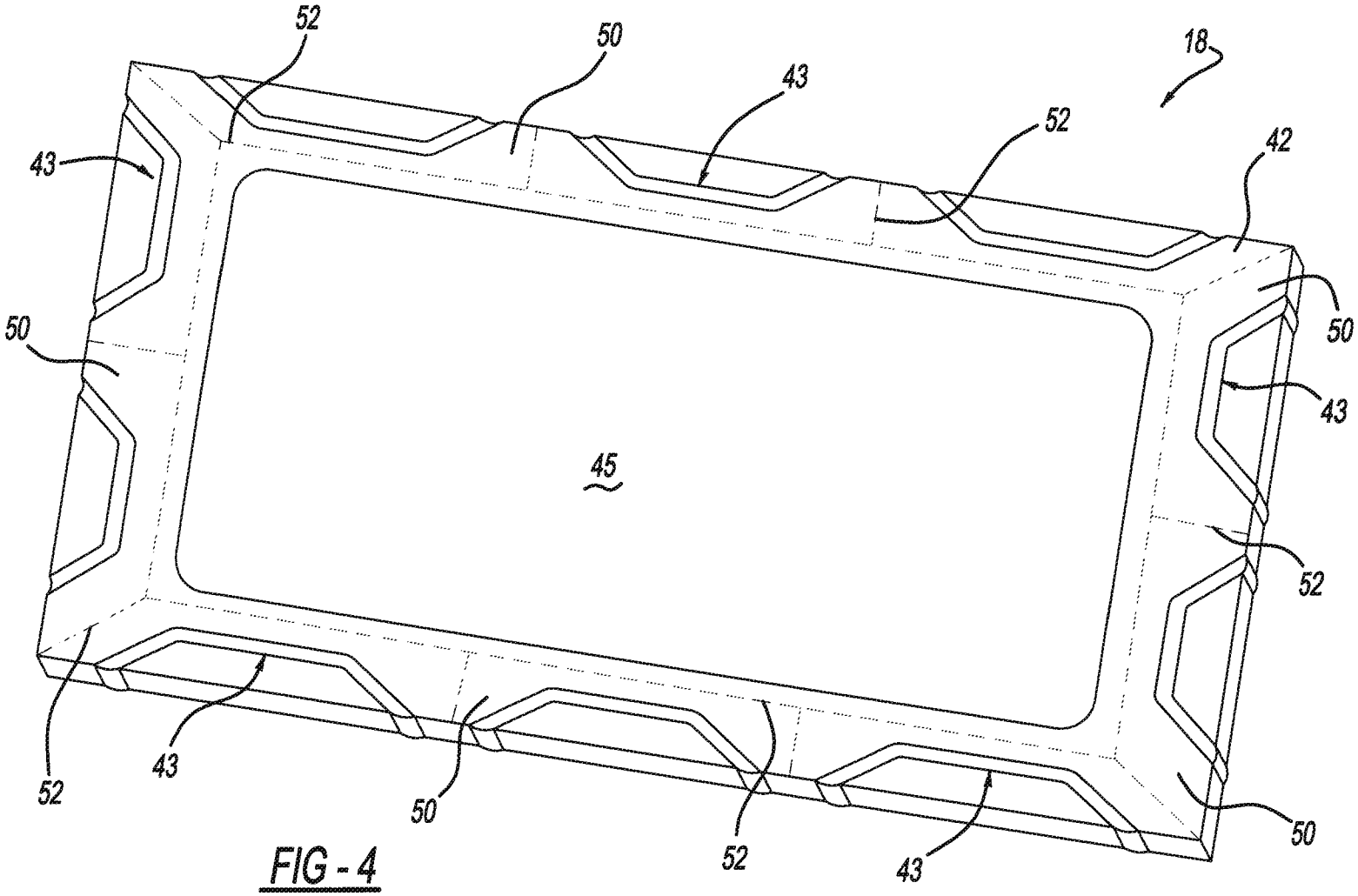
FIG. 4 is a perspective view of a blank stamped using the constraining die illustrated in FIG. 3.

More particularly, as best shown in FIG. 4, blank 18 is illustrated after having been subjected to clamping by binder 28 and forming by drawing punch 20. As can be seen in FIG. 4, blank 18 includes a plurality of crimps 43 formed by draw beads 30 and depressions 34 that peripherally surround contoured portion 45, and are separated by flat areas 50. To remove crimps 43 from blank 18, blank 18 may then be may be cut along the dotted lines 52 (which are for illustrative purposes only) that overlie flat areas 50 between the crimps 43 imprinted on blank 18, and around a periphery of the contoured portion to avoid cutting through the crimps 43 imprinted into the blank 18.

Figure 5:
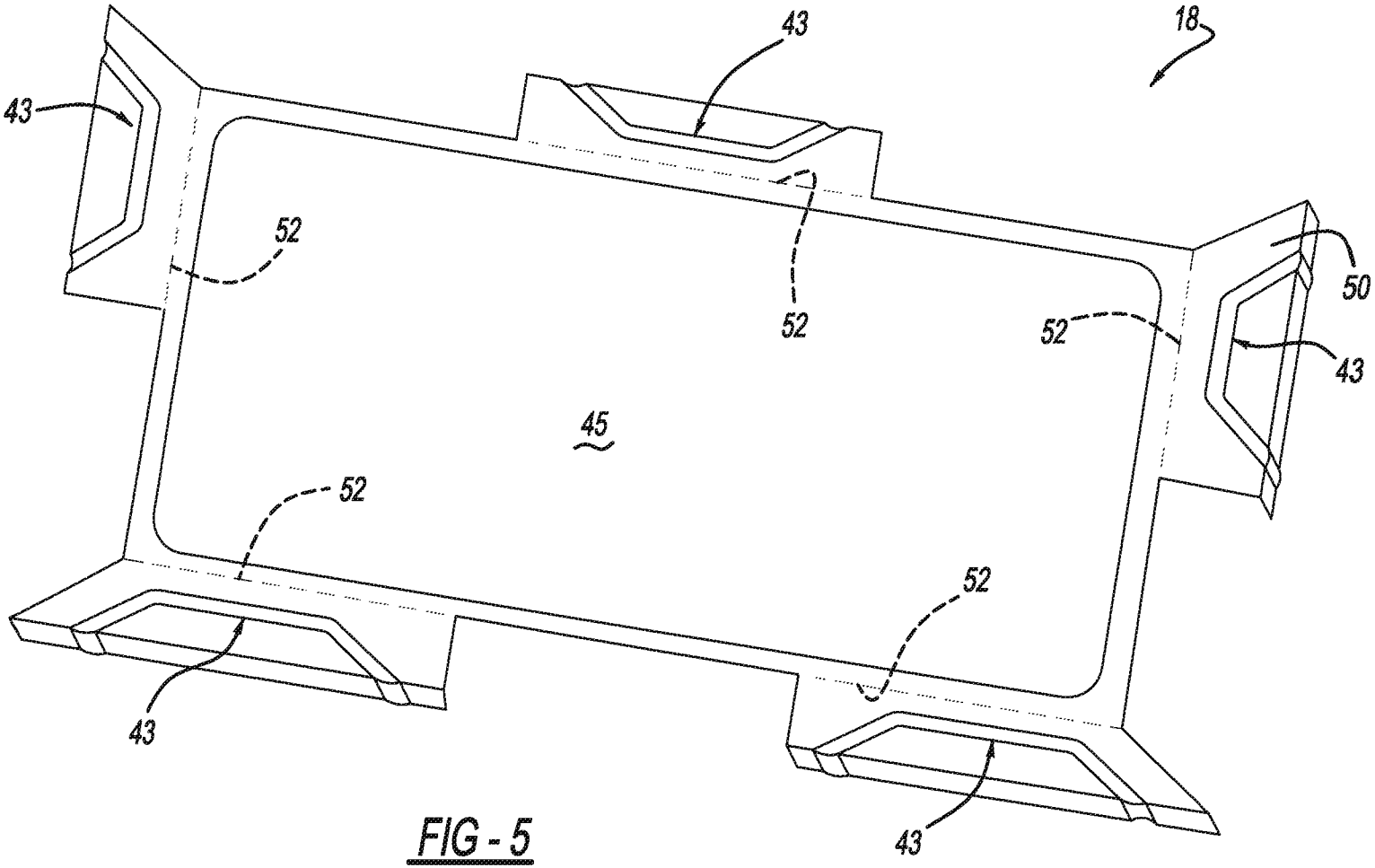
FIG. 5 is a perspective view of the blank illustrated in FIG. 4 after undergoing a first trimming process.
Figure 6:
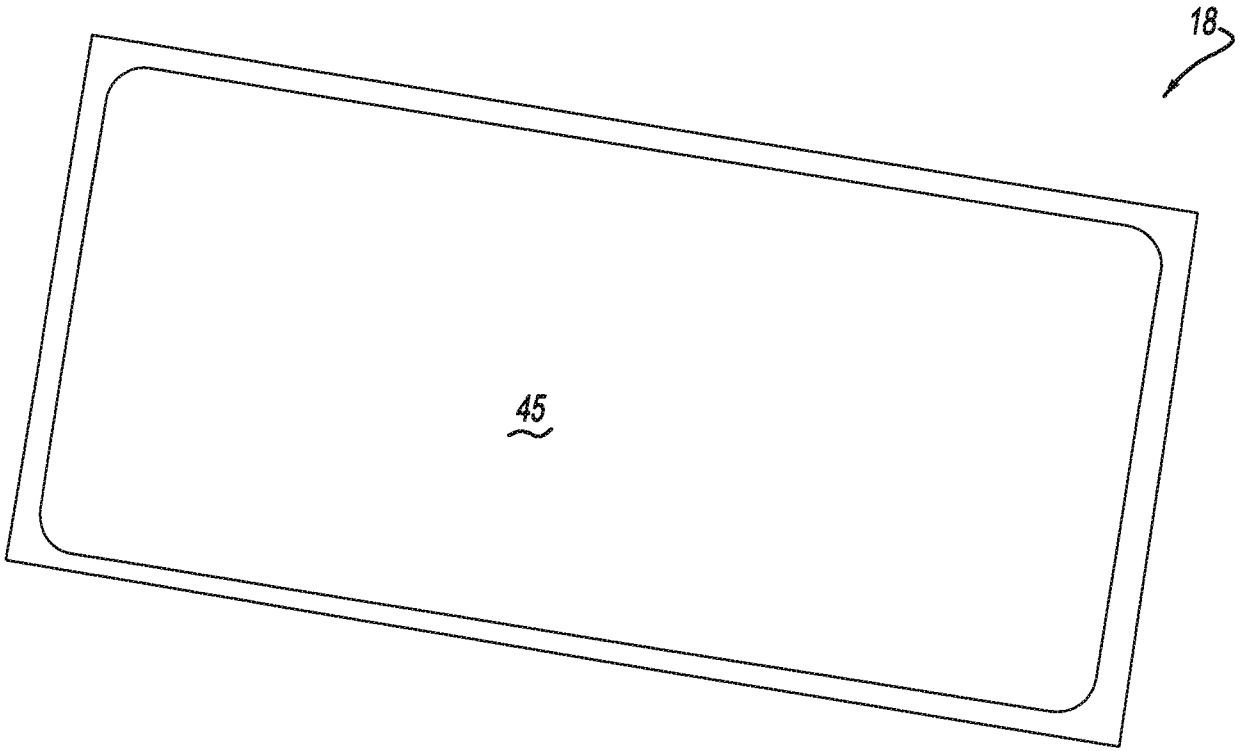
FIG. 6 is a perspective view of the blank illustrated in FIG. 5 after undergoing a second trimming process.

More specifically, as best shown in FIGS. 5 and 6, during a first trimming process a trimming die trims alternating crimps 43 (FIG. 5) from the blank 18 by trimming the crimps 43 along lines 52. Then, during a second trimming process, the remaining crimps 43 are removed by trimming the crimps 43 from the blank 18 along the lines 52 (FIG. 6). As can be seen in FIG. 5, the trimming dies avoid cutting through the crimps 43. In this manner, the generation of dust, debris, and slivers that typically occur during the trimming process can be substantially eliminated, or at least substantially minimized.

Figure 7:
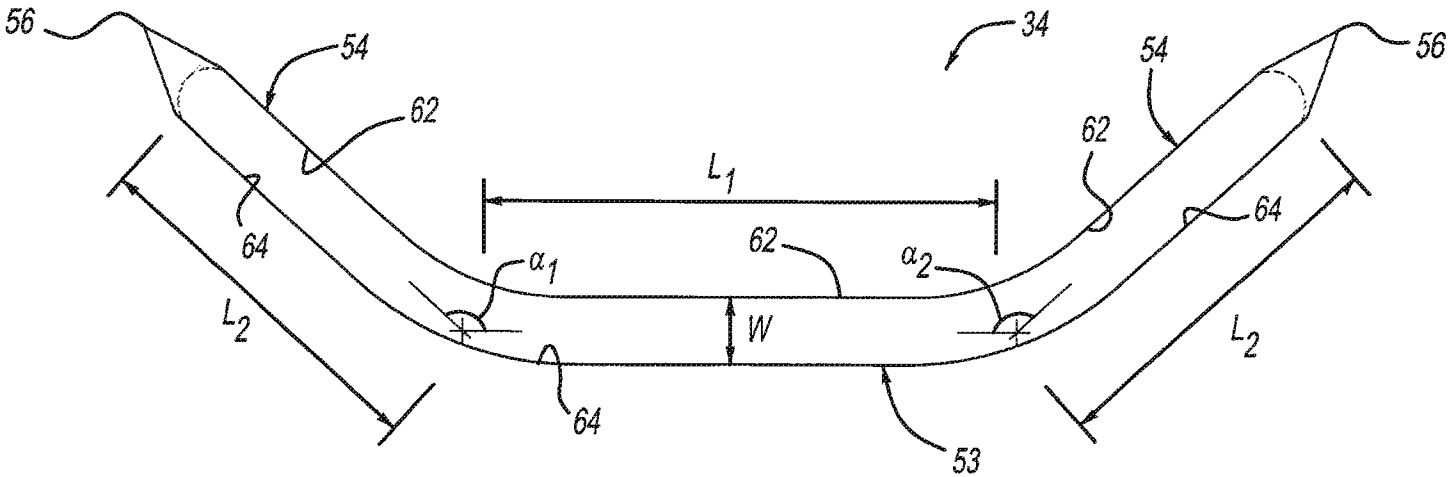
FIG. 7 is a perspective of an exemplary depression that mates with a correspondingly-shaped draw bead according to a principle of the present disclosure.

Now referring to FIG. 7, it can be seen that each depression 34 (and each correspondingly-shaped male draw bead 30) includes a central portion 53 that extends along an edge of cavity 16, and a pair of end portions 54 that extend away from cavity 16. Although illustrated as being linear, it should be understood that central portion 53 may have a slight curvature in a direction away from cavity 16. Regardless, central portion 53 has a length L1, and end portions 54 include a length L2. Although variable, it is preferable that a sum of the lengths L2 is about equal to the length L1 of central portion 53. Central portion 53 and end portions 54 may each include the same width W. It should be understood, however, that end portions 54 may include a width different from that of central portion 53 without departing from the scope of the present disclosure. L1 is preferably in the range of 10 cm to 40 cm, while L2 is preferably in the range of 5 cm to 20 cm. Other lengths for L1 and L2, however, are contemplated and not out of the scope of the present disclosure. A depth of depression 34 (or height of drawing bead 30) may be in the range of 5 mm to 20 mm.

End portions 54 each include a terminal end 56. Although not required by the present disclosure, a depth of end portions 54 may gradually decrease in a direction toward terminal ends 56. End portions 54 extend away from central portion 53 and cavity 16 at angles $\alpha 1$ and $\alpha 2$, respectively. In some embodiments, $\alpha 1$ may be equal to $\alpha 2$. In other embodiments, $\alpha 1$ and $\alpha 2$ are not equal. Preferably, $\alpha 1$ and $\alpha 2$ range between 30 degrees and 80 degrees. More preferably, $\alpha 1$ and $\alpha 2$ range between 45 degrees and 60 degrees. End portions 54 extend away from central portion 53 to provide depressions 34 with a flared configuration. As will be described in more detail below, the flared configuration of depressions 34 prevents the formation of the buckles 6 (see FIG. 1) between the crimps 43 formed in blank 18 during the stamping process.

During the stamping process, edge portion 42 of blank 18 is drawn toward cavity 16, but is retained due to engagement between male draw beads 30 and depressions 34. Due to edge portion 42 being drawn toward cavity 16 and being retained between male draw beads 30 and depressions 34, blank 18 experiences elevated tensile strains in a lateral direction (i.e., to the left in the figure), which are exacerbated at locations of corners 58, 60, 62, and 64 (FIG. 2A). In particular, blank 18 experiences the most tensile strain at corner 64 of depression 34. Due to the elevated tensile strains in the lateral direction at corner 64, blank 18 may buckle, which may cause the part to be drawn further into cavity 16 than desired, which results in an incorrectly stamped part that requires it to be discarded. Discarding the incorrectly stamped part increases material costs, which drives up manufacturing costs associated with manufacturing stamped parts.

In addition, notwithstanding the clamping force exerted by bead 38 and depression 34 on blank 18 during the drawing process, blank 18 may stretch due to the tensile strength of the material forming blank 18. After drawing punch 23 is actuated upwards away from constraining die 14, the material forming blank 18 may spring back. The flared configuration provided by end portions 54, however, assists in reducing the buckling illustrated in FIG. 1. In this regard, the flared configuration provided by end portions 54 enables a larger flat area 50 to be formed between depressions 34 and male draw beads 38. This larger flat area 50 enables the material of the blank 18 to be "softer" in these areas 50, which allows the material of the blank 18 to stretch to a greater extent that prevents the buckles 6 from forming. To provide the larger flat area 50, terminal ends 56 of adjacent male draw beads 30 and adjacent depressions 34 should be no less than 1.5 cm apart. In other words, the distance between terminal ends 56 of adjacent male draw beads 30 and adjacent depressions 34 should be 1.5 cm or greater, and preferably between 1.5 cm and 5 cm.

Further, because end portions 54 extend away from cavity 16, the corner 64 of depression 34 in each end portion 54 is also oriented in a direction away from cavity 16. Thus, as the material of blank 18 is being formed and stretched towards cavity 16, the tensile strains experienced by blank 18 is reduced at end portions 54 to an extent that reduces the formation of buckles 6. That is, because end portions 54 extends away from cavity 16, as the material of blank 18 is pulled toward cavity 16 the material will be pulled along corner 64 in end portions 54 to an extent rather than pulled against corner 64. This significantly reduces tensile strains experienced by blank 18 in end portions 54, which reduces the amount of buckling between crimps 43 generated during the stamping process.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A stamping apparatus for stamping a blank, comprising:

a lower die defining a cavity, the lower die including a land portion surrounding the cavity;

a movable upper die including a drawing punch that corresponds to the cavity; and a binder movable towards the land portion of the lower die for engaging an edge portion of the blank, wherein the land portion of the lower die includes a plurality of depressions and the movable binder includes a plurality of beads that correspond to the depressions that mate to crimp the edge portion of the blank when the movable binder engages the edge portion of the blank, each of the plurality of depressions being separated by a flat region of the land portion, and each of the plurality of depressions including a central portion that extends along the cavity and a pair of end portions that extend away from the cavity in a direction that is different from that of the cavity.

2. The stamping apparatus of claim 1, wherein the end portions extend away from the central portion at an angle $\alpha 1$ and an angle $\alpha 2$, respectively.

3. The stamping apparatus of claim 2, wherein $\alpha 1$ is equal to $\alpha 2$.

4. The stamping apparatus of claim 2, wherein $\alpha 1$ is not equal to $\alpha 2$.

5. The stamping apparatus of claim 2, wherein $\alpha 1$ and $\alpha 2$ are each in the range of 30 degrees to 80 degrees.

6. The stamping apparatus of claim 1, wherein the central portion includes a length L1, each of the end portions include a length L2, and a sum of the lengths L2 of the end portions is equal to the length L1.

7. The stamping apparatus of claim 1, wherein a depth of the depression in each of the end portions gradually decreases in a direction from the central portion toward a terminal end of the end portion.

8. The stamping apparatus of claim 1, wherein terminal ends of the end portions of adjacent depressions are spaced apart at a distance of 1.5 cm or greater.

9. A stamping apparatus for stamping a blank, comprising:

a lower die defining a cavity, the lower die including a land portion surrounding the cavity;

a movable upper the including a drawing punch that corresponds to the cavity; and a binder movable towards the land portion of the lower die for engaging an edge portion of the blank, wherein the land portion of the lower die includes a plurality of depressions and the movable binder includes a plurality of beads that correspond to the depressions that mate to crimp the edge portion of the blank when the movable binder engages the edge portion of the blank, the plurality of depressions extending about a perimeter of the cavity, each of the plurality of depressions being separated by a flat region of the land portion, and each of the plurality of depressions including a U-shaped flared configuration such that each of the plurality of depressions includes a central portion that extends along a portion of the perimeter of the cavity and a pair of end portions that extend away from the cavity in a direction that is different from that of the cavity.

10. The stamping apparatus of claim 9, wherein terminal ends of the end portions of adjacent depressions are spaced apart at a distance of 1.5 cm or greater.

11. The stamping apparatus of claim 9, wherein the end portions extend away from the central portion at an angle $\alpha 1$ and an angle $\alpha 2$, respectively.

12. The stamping apparatus of claim 11, wherein al is equal to $\alpha 2$.

13. The stamping apparatus of claim 11, wherein al is not equal to $\alpha 2$.

14. The stamping apparatus of claim 11, wherein $\alpha 1$ and $\alpha 2$ are each in the range of 30 degrees to 80 degrees.

15. The stamping apparatus of claim 9, wherein the central portion includes a length L1, each of the end portions include a length L2, and a sum of the lengths L2 of the end portions is equal to the length L1.

16. The stamping apparatus of claim 9, wherein a depth of the depression in each of the end portions gradually decreases in a direction from the central portion toward a terminal end of the end portion.

* * * * *